United States Patent [19]

Looney et al.

[11] Patent Number: 4,936,585

[45] Date of Patent: Jun. 26, 1990

[54] METHOD OF MANIPULATING AND INTERPRETING PLAYING PIECES

[76] Inventors: Andrew J. Looney, P.O. Box 761, College Park, Md. 20740; John W. Cooper, 4824 River Valley Way, Bowie, Md. 20715

[21] Appl. No.: 428,496

[22] Filed: Oct. 27, 1989

[51] Int. Cl.[5] ..... A63F 3/00

[52] U.S. Cl. ..... 273/236; 273/288; 273/1 R; D21/51

[58] Field of Search ..... 273/236, 260, 288, 264, 273/261, 255, 258, 1 R

[56] References Cited

U.S. PATENT DOCUMENTS

| | | | |
|---|---|---|---|
| 3,887,190 | 6/1975 | Ameri | 273/264 |
| 4,227,696 | 10/1980 | Silverman | 273/260 |
| 4,687,207 | 8/1987 | Darling | 273/271 |
| 4,852,887 | 8/1989 | Li | 273/264 |

FOREIGN PATENT DOCUMENTS

| | | | |
|---|---|---|---|
| 2180765 | 4/1987 | United Kingdom | 273/260 |

OTHER PUBLICATIONS

Looney, Andrew J., "Icehouse", ©1986, p. 7 of *Open 24 Hours.*

*Primary Examiner*—Benjamin Layno

[57] ABSTRACT

A strategy game utilizing two forms of a playing piece, one indicating direction and representing attack, the other indicating position and representing defense. Each player has a plurality of playing pieces. The game begins with all pieces held in storage During the game, playing pieces are put into play and either take up defensive positions or attack defensive pieces already in place. The game ends when all pieces have been played. Participants may make plays at any time they choose. The object of the game is to protect one's defensive pieces while attacking the defensive pieces of one's opponents. The winner is determined through a method of interpreting the success of attacks by examining placement of pieces relative to each other.

5 Claims, 3 Drawing Sheets

METHOD OF MANIPULATING AND INTERPRETING PLAYING PIECES

FIELD OF THE INVENTION

This invention relates to a parlor game played by two or more participants.

The invention consists of a method of manipulating and interpreting playing pieces in an alignment style board game.

DISCUSSION OF PRIOR ART

Heretofore, board games have several carefully defined basic structures. Typically, each player has a turn, in which they make their move(s) as outlined by the rules. The players take their turns in "round-robin" style. Additionally, the manner in which playing pieces are placed is strongly regulated by markings on the board or playing field.

In a fictional story called "Icehouse", by Andrew J. Looney (appearing in the book *Open 24 Hours*, copyright © 1986), the author suggested a board game which departed from these typical structures. In his fictional game, players were not required to wait for their turn, but could make plays whenever they chose. Also, the layout of the playing field in which the game was played was entirely free form.

However, since this was merely a work of fiction, the author did not disclose an actual process by which a game with these atypical characteristics could be played. The author simply suggested the idea. At that time, the outlined game concepts were not workable.

SUMMARY OF THE INVENTION

This invention is an improvement over the prior art in that it provides a workable process for a previously unworkable idea. The invention presents a method for manipulating playing pieces in a manner in which players may make plays at any time they choose. Also, the markings on the playing field regulate the game only by specifying where unplayed pieces are stored and where legitimate plays may be made. This method of manipulating playing pieces can be used as the basis for a board game that provides entertainment and challenges the logic and skill of the participants.

In the inventive game, each player is assigned a multiplicity of small playing pieces which are distinguishable in color, composition, or external markings, or in some other visual manner, from the playing pieces of his opponent(s). The playing pieces can be of varying but similar appearances, such as pyramids of several distinct sizes. It will be possible for the player to position playing pieces in either of two ways, one way having a uniformly-shaped footprint, such as a pyramid standing upright, and the other way indicating a specific direction, such as a pyramid lying on its side. The first of these is a defending position, and the second is an attacking position.

The playing field will be a board or other flat surface with markings or patterns that distinguish the playing area from areas in which each player will store his or her pieces prior to play. Before the game starts, all players will position all of their pieces within the boundaries that define their own storage areas.

The game is then played with all players moving their pieces from their storage areas into the playing field. Pieces can be played in either the defending position or the attacking position. Pieces played in the attacking position will be pointing at those in the defending position. Defending pieces can be protected through a variety of strategies. Attacking pieces can break through such protections through the use of other strategies.

Players may play their pieces at any time they choose. The game will continue until all of the playing pieces have been played. Each player will then receive a final score. The invention includes a method for interpreting the final arrangement of the playing pieces and determining a winner.

DESCRIPTION OF THE INVENTION

Figure 1:
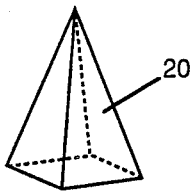
FIG. 1 is a pictorial representation of the basic playing piece used in the preferred embodiment of the game.

FIG. 1 depicts the basic playing piece of the preferred embodiment of this invention, a pyramid 20. Pyramid 20 will exist in a multiplicity of different forms. In the preferred embodiment, it will be extant in several clearly distinguishable sizes and several clearly distinguishable colors. Each player will be assigned a given quantity of pyramids of a single color. This will include pyramids of differing sizes. In the preferred embodiment, each player will receive 15 playing pieces, 5 each of small, medium, and large sizes.

Figure 2:
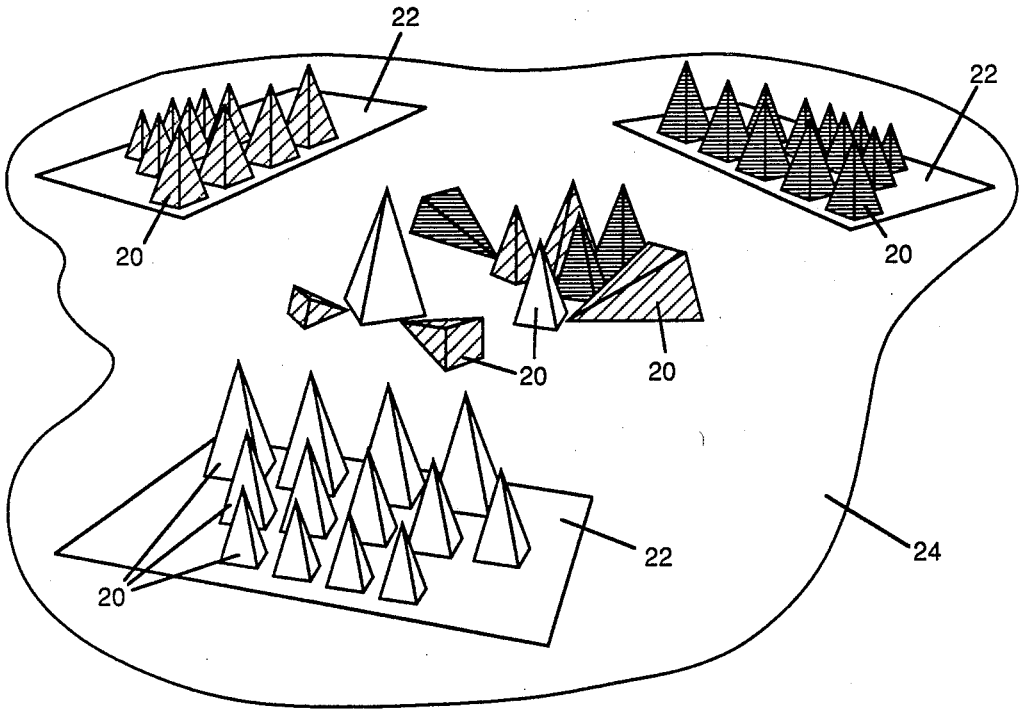
FIG. 2 is a detailed perspective view depicting the game elements in a possible configuration during the game.

Refering to FIG. 2, the game is depicted in a typical configuration while the game is in progress. Pyramid 20 is shown in 3 different colors, one for each of three players, and in three different sizes.

The playing field for the game will be comprised of a flat surface with areas delineating different zones used for the game. A storage zone 22 is an area in which pieces are stored before play. A playing zone 24 is a open area in which legal plays can be made. Storage zone 22 should be just large enough to comfortably receive all of the pieces allocated to a single player. Since the game can be played in a variety of settings, the boundaries of playing zone 24 do not necessarily need to be defined. If the game is played, for example, on a table, the edges of the table might comprise the boundaries of playing zone 24. However, if the game were played on a floor, playing zone 24 might have no specific boundaries.

OPERATION OF THE INVENTION

Before starting to play, each player will position his assigned pieces in his assigned storage zone. On a mutually agreed upon starting signal, all players will be allowed to begin playing. Players will move their assigned pieces out of storage zone 22 and into playing zone 24. They may place their pieces anywhere in the playing zone, within certain limits of the rules as described below. Pyramid 20 may be positioned in either of two ways, either standing upright or lying on its side. A piece placed standing up is called a defending piece and is open to attack. A piece lying on its side is called an attacking piece and can attack defending pieces. Players may place pieces at any time they choose, as frequently or infrequently as they think best. The game ends only when all pieces have been played.

Each playing piece will be assigned a value, which will represent the strength of the playing piece in relation to other playing pieces. In the preferred embodiment, a small pyramid would have a value, or strength, of 1. A medium size pyramid would have a value of 2, and a large pyramid would have a value of 3. These values will have meaning during the game, in analyzing the success or failure of attacks, and can also be used at the end of the game, for the calculation of scores.

The object of the game is to neutralize as many of your opponent's defending pieces as possible, via attack, while keeping as many of your own defending pyramids free from attack as you can. In the preferred embodiment, points will be awarded at the end of the game only for those pieces that were successful in either attacking or defending. The player with the highest score will be the winner.

A successful attack is one in which attacking pieces of a combined strength greater than their target are pointing, in an unobstructed fashion, at an opponent's defending piece. For example, to successfully attack an opponent's defending piece having a value of 2, you must attack it with attacking pieces comprising a total combined value of at least 3. This could be done with a single 3 point pyramid, or with a 2 point pyramid and a 1 point pyramid, or even with three 1 point pyramids. For an attacking piece to be validly attacking a defending piece, its tip must be pointing in an unobstructed fashion at a defending piece, and it must be within a distance of less than its own height away from the defending piece.

Figure 3:
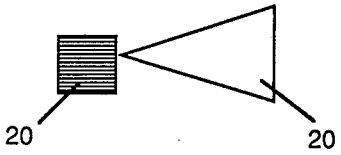
FIGS. 3–13 are simple top views depicting various arrangements of playing pieces at different stages during the game.

FIG. 3 shows a simple attack. A large attacking piece, with a value of 3, is pointing at a small defending piece, with a value of 1. The attack is successful, and the defending piece is defeated.

Figure 4:
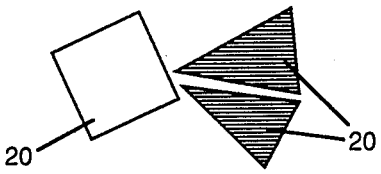

FIG. 4 shows a more complex attack. A large defending piece, with a value of 3, is being attacked by two mid-sized attacking pieces, each having a value of 2. The combined values of the attacking pieces is 4, so the attack is successful, and the defending piece is defeated.

Figure 5:
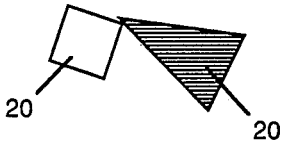

FIG. 5 shows an unsuccessful attack. The mid-sized attacking pyramid is not really pointing at the small defending piece. The direction of attack, indicated by the tip of the attack piece, does not strike the intended target. In this case, the attack has failed, and the defending piece is defending successfully.

Figure 6:
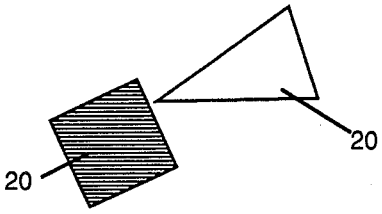

FIG. 6 shows another unsuccessful attack. The two pieces involved are of equal size. Therefore the attack has failed, and the defending piece is defending successfully. However, if another attacking piece were brought to bear on the defending piece, the attacks would then succeed.

Since the object of the game is, in part, to keep defending pieces free from attack (in addition to attacking the opponents' pieces), there are strategies that allow for protection of defending pieces. These strategies involve building walls around defending pieces such that attacking pieces cannot be successfully brought to bear upon them.

Figure 7:
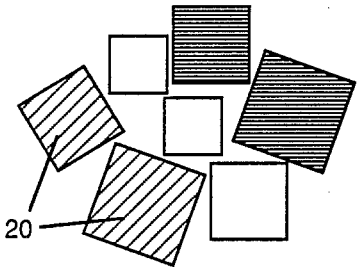

FIG. 7 depicts such a defense. The defending pyramid at the center of the picture is completely surrounded by other pieces. No attacking piece can attack the protected defending piece, because there is no way to point an attack piece, in an unobstructed manner, at the protected defending piece. A protective structure such as this is called a fortress.

Figure 8:
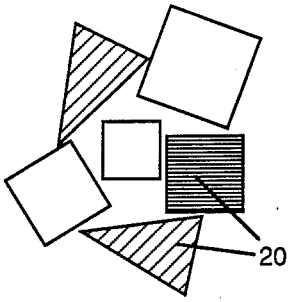

FIG. 8 depicts another fortress. Note that in this figure, some of the fortress walls are formed by attacking pieces. Attacking pieces and defending pieces, belonging to anyone, can be used as fortress walls. Natural boundaries, such as the edge of a table, can also serve as fortress walls.

This brings up the issue of how close pieces must be placed together to form functional fortress walls. If there is a gap of any meaningful size between the pieces that form the walls of a fortress, then attacking pieces can be placed in those gaps, breaking the defense.

For an attacking piece to successfully attack a defending piece which is protected by a fortress, it must breach the fortress walls. To do this, the tip of the attack piece must protrude past the closest approach between the two pieces that form the barrier.

Figure 9:
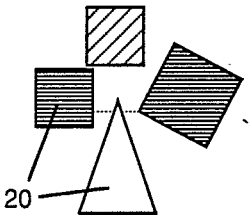

Referring, then, to FIG. 9, the attacking piece is successfully attacking the defending piece, because it is protruding past the point at which the two wall pieces come nearest to each other.

Figure 10:
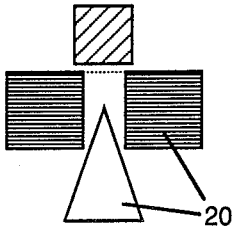

However, in FIG. 10, the attacking piece is not successfully attacking the defending piece. In this picture, the point at which the two wall pieces come nearest to each other is ambiguous. In such a case, the attacking piece must protrude past the innermost closest approach of the two wall pieces.

Thus, suppose a player wishes to attack a defending piece that is inside of a fortress. There is a gap between two of the pieces forming the fortress walls, and the player thinks this gap is just big enough to squeeze in the tip of an attacking piece. The player should draw an imaginary line between the point at which the two wall pieces come closest to each other. If the player can get the tip of an attacking piece past that line, the attack is good; if not, it fails.

Figure 11:
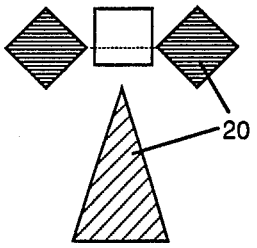

If the shortest line between two wall pieces falls outside of the path between the attacking piece and the targeted defending piece, then those pieces do not form a functional wall. This case is shown in FIG. 11. In this picture, the attack succeeds. The closest approach between the two wall pieces is a line that goes through the targeted defending piece. Since the barrier to be breached in this case isn't actually in the path of the attack, it isn't really a barrier.

In the preferred embodiment, pieces will not be moved after they have been played, except under certain conditions. One such case is redundant attacks. In order to successfully attack a defending piece, the attacking piece(s) must have a total value of least 1 point more than that of the defending piece. It is legal to use more force than is required, but this is not necessarily wise. If a defending piece is attacked with more force than is needed, such that any single attacking piece can be taken away without rendering the overall attack unsuccessful, then the player who owns the defending piece may do just that.

For example, suppose a player attacks a 2 point defending piece using two 3 point attacking pieces. In this case, one of the attacking pieces is redundant. Only one 3 point attacking piece is needed to do the job. The other attacking piece could be removed, and the defending piece would still be successfully attacked.

The person whose defending piece has suffered a redundant attack has the option of capturing the redundant piece(s). He may remove any of the attacking pieces he wishes, as long as the attack remains successful. Captured pieces are returned to storage area 22 of the player who captured the piece. This player then has control of the piece, even though it will be of a color (or other visually distinguishable feature) other than his own. He may play the captured piece anyway he wishes; however, any points generated by the piece are awarded to the player who originally owned the piece. The player who captures a piece merely has control, not ownership, of that piece.

Redundant attack pieces can be captured only by the player whose defending piece is being attacked. The player can capture the piece at anytime he wishes, not necessarily when he first notices it.

Redundant attacks can occur by mistake or on purpose. A player can easily attack an opponent's piece without realizing it was already attacked. A player can also redundantly attack a piece in order to break a fortress. FIG. 12 shows an example of this.

Figure 12A:
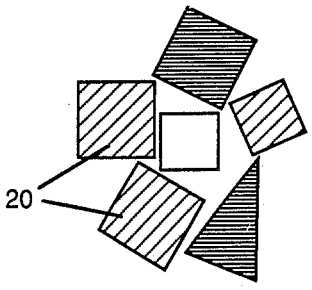

FIG. 12A shows a typical fortress. One of the walls of this fortress is formed by an attack piece. It will be possible to remove this attack piece, and thus destroy the integrity of the fortress, by making a redundant attack.

Figure 12B:
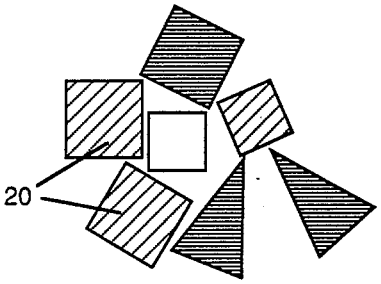

FIG. 12B shows this same fortress at a later point in the game. An additional, redundant attack piece has been put into place. Since the defending piece has a value of 1, and each attacking piece has a value of 2, either of the attacking pieces could be captured by the owner of the defending piece.

Figure 12C:
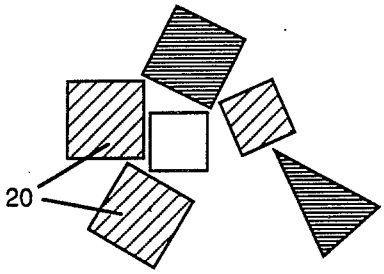

FIG. 12C shows the same fortress at a still later point in the game. The attacking piece that formed part of the fortress wall has been captured, leaving the defending piece inside the fortress unprotected.

Figure 12D:
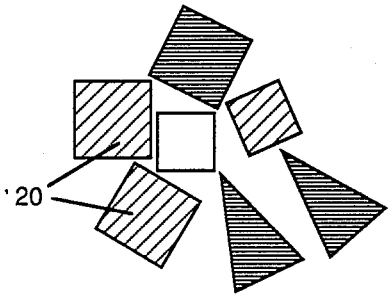

FIG. 12D shows the final stage of the maneuver. The piece in the fortress, left unprotected, has now been successfully attacked.

The invention, as described thus far, leaves players with more incentive to play attacking pieces than to play defending pieces. Methods are therefore required to motivate players to play defending pieces.

In the preferred embodiment, therefore, players would be required to play a given number of defending pieces (typically 2) before playing any attacking pieces.

Additionally, in the preferred embodiment, players would be required to keep at least 1 defending piece free from successful attack at all times. Any player who is observed to have no successfully defending pieces in the playing zone would automatically lose the game. In the preferred embodiment, there would be a grace period during which players would be excluded from this rule. During this grace period, they would have an opportunity to build up their defenses. In the preferred embodiment, this grace period would be measured by the number of unplayed pieces that a player has remaining in his storage area. Once the number of pieces in their storage area went below a certain limit (typically 8), they would be subject to the rule requiring them to have at least 1 successfully defending piece. However, the grace period could be measured by other means. For example, it could be a simple time limit.

Other methods of motivating players to play defending pieces could be employed. For example, extra points could be awarded for each successfully defending piece, or for each discrete fortress.

The invention requires that, once played, pieces not be moved, even slightly, except under special circumstances. Frequently it is the case that a player wishes to squeeze a piece into a spot where it won't easily fit. Sometimes he will manage to do this without jarring any of the pieces already in place, and sometimes he won't. A player should pay a penalty if he moves any of the pieces already on the board while attempting to place his own piece. In the preferred embodiment, he will give away the piece he was attempting to play, to the opponent of his choice. The recipient of the penalty piece will treat it as a captured piece, as discussed above. An attempt should also be made to restore the played pieces to the state they were in before they were shifted.

In the preferred embodiment, players would be limited in the speed with which they play pieces. Players should be allowed to remove only one piece from their storage area at a time. Each play they make should be a single, discrete action. There should be no two fisted playing. Players should not be placing one piece in the playing area with one hand while using the other hand to retrieve the next piece from their storage area. Players should not be allowed to alternate hands in order to play quickly. However, this should not compel players to use only one hand during the course of the game. Players should be allowed to use two hands to place or remove a piece in a difficult spot. They should also be allowed to change hands, as long as they do so only by passing a piece from one hand to the other.

In the preferred embodiment, attacking pieces are not permitted to attack other attacking pieces. They are also not permitted to attack pieces of their own color, or to be positioned such that they are not attacking anything. Such attacks would be unsuccessful, and no points would be awarded to attacking pieces played in this way. Normally, players would not be allowed to make such plays. However, it is possible for an attacking piece to be affected by other plays such that a situation like this could exist. If a valid attack is made, and then other pieces are played such that they obstruct the line of attack of the first attacking piece, then that attack is neutralized. Such a situation is depicted in FIG. 13.

Figure 13A:
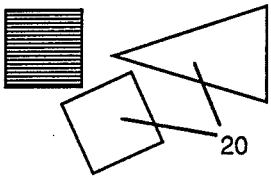
Figure 13B:
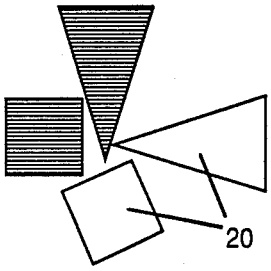

FIG. 13A depicts a typical attack configuration. FIG. 13B depicts this same configuration at a later point in the game. In FIG. 13B, an attacking piece has been placed in such a way as to make an earlier successful attack unsuccessful.

The game ends when all pieces have been moved from the storage areas into the playing area. Any redundant attacks that are noticed after the last piece has been played, or even created by the final play, must remain as they are.

In the preferred embodiment, scores will be awarded to each player at the end of the game. Each player would receive points, equal to the values of the pieces, for each of their successful attacking pieces and successful defending pieces. The player with the highest score would be the winner.

In cases where pieces owned by different players participated jointly in successful attacks, players would still get points for their pieces. For example, a red 3 point piece might be attacked by a blue 2 point piece and a green 2 point piece. In this case, blue and green would each get 2 points, and red would get 0.

SUMMARY, REFLECTIONS, AND SCOPE

The reader will see that the described method of manipulating and interpreting playing pieces can be used as the basis for a board game in which players are not limited by traditional round-robin style play and rigid game board layouts. Such a game would be fast-paced, challenging, unpredictable and atypical.

Figure 14:
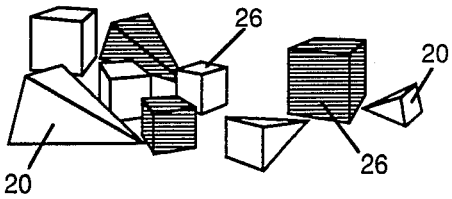
FIG. 14 depicts an alternate embodiment of the playing pieces of this invention.

While the above description contains many specifities, these should not be construed as limitations on the scope of the invention, but rather as an exemplification of one preferred embodiment thereof. Many other variations are possible. For example, instead of using pyramid 20, which has a 4-sided base, pyramids having a 3-sided or 5-sided base could be employed. Instead of using 3 distinct sizes of pyramid 20, 5 sizes could be employed. Similarly, the playing pieces could all be of one size, but instead feature numerical markings that define the value of the piece. Pieces belonging to different players could be composed of different materials or have different patterns described upon them rather than being of differing colors. Instead of employing a single type of playing piece which can be positioned in either of 2 ways, the game could be played with 2 different types of playing pieces, one being used for defending plays and the other for attacking plays. An example of this is shown in FIG. 14, which depicts the use of pyramid 20 for attack and a cube 26 for defense. Different scoring methods could be used. For example, instead of awarding points, the game could played such that the winner is the player with the largest number of successfully defending pieces. Different numbers of players could participate. The game could be played with teams instead of individuals. However, the basic method of manipulating the playing pieces will be the same. Thus, the scope of the invention should be determined by the appended claims and their legal equivalents, rather than by the examples given.

We claim:

1. A method of playing a board game of skill and strategy comprising the steps of:

(a) providing a plurality of playing pieces for each player, said playing pieces being visually distinguishable from those assigned to other players, each playing piece having a pointer means indicating a specified direction, (b) providing a playing field comprising a playing area into which said playing pieces are positioned when played and storage areas in which said playing pieces are stored when unplayed, (c) manipulating said playing pieces such that players may move said playing pieces from said storage areas into said playing area in individual plays comprising either placing said playing pieces in defensive orientations, such that said playing pieces are positioned at any desired locations within said playing area and are oriented such that the pointing means of said playing pieces are not pointing in a direction parallel to the plane of said playing area, thereby establishing the defensively oriented playing pieces as defense pieces, or placing said playing pieces in offensive orientations, different from said defensive orientations, such that said playing pieces are positioned at other locations within said playing area and are oriented such that the pointing means of said playing pieces are pointing in a direction parallel to the plane of the playing area and are pointing at said defense pieces, thereby establishing the offensively oriented playing pieces as attack pieces, (d) interpreting the placement of said playing pieces relative to the others by which the success or failure of individual plays can be determined, such that said attack pieces are successful only if they point in an unobstructed fashion at said defense pieces, and said defense pieces are successful only if they are not directly in the path of the indicated direction of said attack pieces, (e) identifying a winner by employing said method of interpreting the placement of said playing pieces.

2. The method of interpreting the success or failure of individual plays of claim 1, further including the steps of:

(a) assigning values to said playing pieces according to visually identifiable differences in said playing pieces, (b) interpreting the success or failure of individual plays such that said successful attack pieces consist of said successful attack pieces that have a greater combined value than the targeted defense piece.

3. The method of identifying a winner of claim 1 wherein points are assigned to each player for said successful attack pieces and said successful defense pieces.

4. The method of manipulating playing pieces of claim 1 wherein players may make plays at any time they desire.

5. A method of playing a board game of skill and strategy comprising the steps of:

(a) providing a plurality of playing pieces with different identifying means for showing possession by each player, said playing pieces being of two distinct types, the first type of playing piece having a pointer means indicating a specified direction and thereby representing attack, and the second type of playing piece being visually distinguishable from said first type of playing piece and thereby representing defense, (b) providing a playing field comprising a playing area into which said playing pieces are positioned when played and storage areas in which said playing pieces are stored when unplayed, (c) manipulating said playing pieces such that players may move said playing pieces from said storage areas into said playing area, placing the defense pieces at any desired locations within said playing area, and placing the attack pieces at other locations within said playing area, orienting said attack pieces such that the pointing means of said attack pieces are pointing at said defense pieces, (d) interpreting the placement of said playing pieces relative to the others by which the success or failure of individual plays can be determined, such that said attack pieces are successful only if they point in an unobstructed fashion at said defense pieces, and said defense pieces are successful only if they are not directly in the path of the indicated direction of said attack pieces, (e) identifying a winner by employing said method of interpreting the placement of said playing pieces.

* * * * *